United States Patent [19]

Blackburn et al.

[11] 4,294,615

[45] Oct. 13, 1981

[54] TITANIUM ALLOYS OF THE TIAL TYPE

[75] Inventors: Martin J. Blackburn, Kensington; Michael P. Smith, Glastonbury, both of Conn.

[73] Assignee: United Technologies Corporation, Hartford, Conn.

[21] Appl. No.: 60,265

[22] Filed: Jul. 25, 1979

[51] Int. Cl.[3] ..... C22C 14/00; C21D 1/00

[52] U.S. Cl. ..... 75/175.5; 148/11.5 F; 148/12.7 B; 148/32.5; 148/133

[58] Field of Search ..... 75/175.5; 148/11.5 F, 148/12.7 B, 133, 32.5

[56] References Cited

U.S. PATENT DOCUMENTS

| | | | |
|---|---|---|---|
| 2,781,261 | 2/1957 | Kamlet | 75/175.5 X |
| 2,880,087 | 3/1959 | Jaffee | 75/175.5 X |
| 2,880,089 | 3/1959 | Vordahl | 75/175.5 |
| 2,881,105 | 4/1959 | Gullett | 75/175.5 X |
| 2,939,786 | 6/1960 | Ginsberg et al. | 75/175.5 |
| 3,008,823 | 11/1961 | McAndrew | 75/175.5 |
| 3,203,794 | 8/1965 | Jaffee et al. | 75/175.5 |
| 3,540,878 | 11/1970 | Levine et al. | 75/175.5 |

FOREIGN PATENT DOCUMENTS

| | | | |
|---|---|---|---|
| 595980 | 4/1960 | Canada | 75/175.5 |
| 596202 | 4/1960 | Canada | 75/175.5 |
| 621884 | 6/1961 | Canada | 75/175.5 |
| 782564 | 9/1957 | United Kingdom | 75/175.5 |

OTHER PUBLICATIONS

Jordan et al., "Approximate Phase . . . Titanium-Vanadium-Aluminum", Trans. Am. Soc. Metals, 1955, pp. 1-16.

Bumps et al., "Titanium-Aluminum System", Trans. AIME, Jun., 1952, Journal of Metals, pp. 609-614.

*Primary Examiner*—L. Dewayne Rutledge
*Assistant Examiner*—W. G. Saba
*Attorney, Agent, or Firm*—C. G. Nessler

[57] ABSTRACT

Cast and forged titanium alloys suited for use at temperatures over 600° C. are based on TiAl gamma phase structure. Useful alloys have about 1.5% or greater tensile ductility at temperatures of 260° C. and below, thereby making them fabricable and suited for engineering applications. Disclosed are alloys having weight percent compositions of 31-36 aluminum, 0-4 vanadium, balance titanium (in atomic percent, about: 45-50Al, 0-3V, bal Ti). The inclusion of about 0.1 weight percent carbon improves creep rupture strength. To obtain high tensile strength, the alloys are forged at about 1025° C. and aged at about 900° C.; to obtain higher creep rupture strength and tensile ductility, a solution anneal at about 1150° C. is interposed before aging.

6 Claims, 5 Drawing Figures

AF = AS FORGED DA = DIRECT AGE STA = SOLUTION + AGE

TITANIUM ALLOYS OF THE TIAL TYPE

The United States of America government has rights in this invention pursuant to Contract F33615-74-C-1140 awarded by the Air Force.

BACKGROUND

The present invention relates to titanium alloys usable at high temperatures, particularly those of the TiAl gamma phase type. Titanium alloys have found wide use in gas turbines in recent years because of their combination of high strength and low density, but generally, their use has been limited to below 600° C. by inadequate strength and oxidation properties. At higher temperatures, relatively dense iron, nickel and cobalt base superalloys have been used. However, lightweight alloys are still most desirable, as they inherently reduce stresses when used in rotating components.

While major work was performed in the 1950's and 1960's on lightweight titanium alloys for higher temperature use, none have proved suitable for engineering application. To be useful at higher temperatures, titanium alloys need the proper combination of properties. In this combination are properties such as high ductility, tensile strength, fracture toughness, elastic modulus, resistance to creep, fatigue, oxidation, and low density. Unless the material has the proper combination, it will fail, and thereby be use-limited. Furthermore, the alloys must be metallurgically stable in use and be amenable to fabrication, as by casting and forging. Basically, useful high temperature titanium alloys must at least outperform those metals they are to replace in some respects, and equal them in all other respects. This criterion imposes many restraints and alloy improvements of the prior art once thought to be useful are, on closer examination, found not to be so. Typical nickel base alloys which might be replaced by a titanium alloy are INCO 718 or INCO 713. The density-corrected stress rupture capabilities of these materials are shown in FIG. 1 together with the best commercially available titanium base alloys. It is seen that prior titanium alloys had inferior properties to nickel alloys. Alloys of the present invention, to be discussed below, are also known on the Figure.

Heretofore, a favored combination of elements for higher temperature strength has been titanium with aluminum, in particular alloys derived from the intermetallic compounds or ordered alloys $Ti_3Al$ ($\alpha_2$) and TiAl ($\gamma$). It should be evident that the TiAl gamma alloy system has the potential for being lighter, inasmuch as it contains more aluminum. Laboratory work in the 1950's indicated these titanium aluminide alloys had the potential for high temperature use to about 1000° C. But subsequent engineeing experience with such alloys was that, while they had the requisite high temperature strength, they had little or no ductility at room and moderate temperatures, i.e., from 20° to 550° C. Materials which are too brittle cannot be readily fabricated, nor they can they withstand infrequent but inevitable minor service damage without cracking and subsequent failure. They are not useful engineering materials to replace other base alloys.

There are two basic ordered titanium aluminum compounds of interest-$Ti_3Al$ and TiAl which could serve as a base for new high temperature alloys. Those well skilled recognize that there is a substantial difference between the two ordered phases. Alloying and transformational behavior of $Ti_3Al$ resemble those of titanium as the hexagonal crystal structures are very similar. However, the compound TiAl has a tetragonal arrangement of atoms and thus rather different alloying characteristics. Such a distinction is often not recognized in the earlier literature. Therefore, the discussion hereafter is largely restricted to that pertinent to the invention, which is within the TiAl gamma phase realm, i.e. TiAl, 50Ti-50Al atomically, and about 65Ti-35Al by weight.

With respect to the early titanium alloy work during the 1950's, several U.S. and foreign patents were issued. Among them were Jaffee U.S. Pat. No. 2,880,087, which disclosed alloys with 8–34 weight percent aluminum with additions of 0.5 to 5% beta stabilizing elements (Mo, V, Cb, Ta, Mn, Cr, Fe, W, Co, Ni, Cu, Si and Be). The effects of the various elements were distinguished to some extent. For example, vanadium from 0.5–50% was said to be useful for imparting room temperature tensile ductility, up to 2% elongation, in an alloy having 8–10% aluminum. But with the higher aluminum content alloys—those closest to the gamma TiAl alloy—ductility was essentially non-existent for any addition. Likewise, Gullett in U.S. Pat. No. 2,881,105 mentions a 6–20 weight percent aluminum alloy strengthened by adding up to 2% vanadium.

Jaffee in Canada Pat. No. 596,202 mentions other useful alloys of less than 8 weight percent aluminum while indicating the problem of hot workability for higher aluminum contents. The problem is said to be overcome by the addition of the aforementioned beta stabilizing elements in combination with germanium (an alpha stabilizer). Jaffee discloses the utility of carbon in 0.05 to 0.3%, to improve the hot strength of high (up to 32%) aluminum containing alloys of his particular invention. Similar art is revealed in Finlay et al. Canada Pat. No. 595,980, wherein it is also said that other elements, such as molybdenum, manganese, vanadium, columbium, and tantalum are useful. But a review of the data in the 595,980 patent and specification indicates little basis for distinguishing between the elements and shows a prevalence of "zero" tensile elongations at room temperature. Jaffee in Canada No. 621,884 discloses aluminum contents of 34 to 46 weight percent. Noted are the alloys' lack of responsiveness to heat treatment. No data on tensile elongation is given, but is inferred that 34–46% aluminum gives maximum ductility based on the low hardness values. (This is obviously an incorrect inference as our work shows Ti-38%Al has a low hardness and no tensile ductility at ambient temperature). Both alpha and beta promotors are indicated as desirable additions in 0.1 to 5% amounts but no suggestion is made for selection within its broad group. In early published work, such as "Ti-36 Pct Al as a Base for High Temperature Alloys", by McAndrew and Kessler in Transactions AIME, Vol. 206, p. 1384ff (1956), many TiAl compositions with additions including niobium and tantalum were investigated, showing improved creep and limited improvement in room temperature properties. Other investigators reported on hardness and lattice parameters for alloys containing zirconium and yttrium. More fundamental studies under U.S. Air Force sponsorship were carried out to investigate alloying fundamentals in the mid-1970's. Air Force and private work indicated that Zr, Ni, In, and Ga increased TiAl strength but not ductility. During the past twenty years, there also has been work on various ternary systems including Ti-Al-V. For example, see Kornilov et al in "Metal Science and the Application of Titanium and its Alloys" Volume 8, 92 Nauka Press, Moscow (1965). Most of this work has been concerned with phase identification and stability ranges rather than the development of useful alloys.

Despite these past revelations, TiAl alloys having engineering and commercial utility have not been identified and have not made available. This can be attributed to the limited evaluations and necessarily broad approaches of the past. The prior art teaches some broad but contradicting approaches. There is better understanding today and considerable ongoing research, of which this invention is a product. But it is not yet responsible to declare a comprehensive insight into obtaining high temperature strength and low temperature ductility in intermetallic titanium alloys. As will be shown below, the broad teachings of the past are now found not to be entirely accurate and useful. For example, all transition elements were considered similar in effect in much of the prior art.

SUMMARY OF THE INVENTION

It is an object of the present invention to provide an improved titanium aluminum alloy of the TiAl gamma type which has both high temperature creep strength and moderate and room temperature ductility, and which can be manufactured by conventional processes.

In the prior art the broad compositional ranges of TiAl alloys were set forth. The ranges were quite broad, the narrowest being 34–46 weight percent aluminum (Jaffee, Canada Patent 621,884). The addition of vanadium was also disclosed, but interchangeably with other elements and in broad ranges. Distinction between vanadium and other beta promoting elements was scant. In other instances, vanadium was found useful in low aluminum content alloys but not in high aluminum content alloys. The work which had led to the present invention has revealed that in fact the aluminum content in a binary TiAl alloy can very critically affect properties. Further, it has been discovered that vanadium is unique, compared to other like transition elements.

According to the present invention, a unique and useful combination of tensile ductility and high temperature strength are obtained in a titanium alloy comprising a rather narrow composition range of aluminum, between 48–50 atomic percent, balance titanium. To the aforementioned alloy, various elements may be added for altering properties. A preferred alloy consists of by weight percent, 34–36 aluminum, balance titanium (atomically, Ti-48/50Al). Alloys with less aluminum than those of the invention have higher strength, but ductilities much less than 1.5%. Alloys with more aluminum, greater than the invention, have lower strengths and lower ductilities.

In a principal embodiment of the invention, vanadium is added in 0.1–4 weight percent to improve room and moderate temperature ductility without adversely affecting high temperature strength. It has been shown that vanadium is unique among other elements in this respect. Inventive alloys have by weight percent 31–36Al, 0.1–4V, balance Ti; preferred alloys have 34–36Al, 0.7–2.0V, balance Ti. (Atomically, these alloys are 45–50Al, 0–3V, bal Ti and 48–50Al, 0.5–1.5V, bal Ti).

The addition of small amounts of other elements is countenanced in the invention. Carbon of about 0.1 weight percent enhances creep rupture strength, although it lowers ductility. The inventive alloys can be used in the cast plus forged condition. Or the forgings may be heat treated by aging to improve tensile strength. Alternately, they may be solutioned and aged to enhance creep rupture strength and tensile ductility. The invention provides new alloys which have properties suited to engineering applications. As shown in FIG. 1, alloys of the invention have weight-adjusted properties better than some common nickel alloys and are a substantial improvement over pre-existing alloys. Because of their appreciable low and intermediate temperature ductilities, the new alloys can be forged using conventional isothermal die forging equipment and easily attainable process steps.

DESCRIPTION OF THE PREFERRED EMBODIMENT

The preferred embodiment is described in terms of atomic percents (a/o) of elements as this is the manner in which it was ascertained. But, for convenience of searchers of patent art, the invention is claimed in weight (w/o). Those skilled in the art will readily convert from atomic percents to weight percents. As a casual aid, the binary alloy titanium weight and atomic equivalents are presented in Table 1. In a research program ensuing over several years, over 120 alloys were cast and evaluated. The objective was to ascertain an alloy with tensile ductility of over 1.5% at room temperature and having a specific strength (strength/density ratio) equal or greater than nickel superalloys in current use. As references, the alloys INCO 718 (19Cr-0.9Ti-0.6Al-3Mo-18Fe-5Cb+Ta-Bal Ni, by weight) and IN 713C (14Cr-1Ti-6Al-4.5Mo-Bal Ni, by weight) were used.

Figure 1:
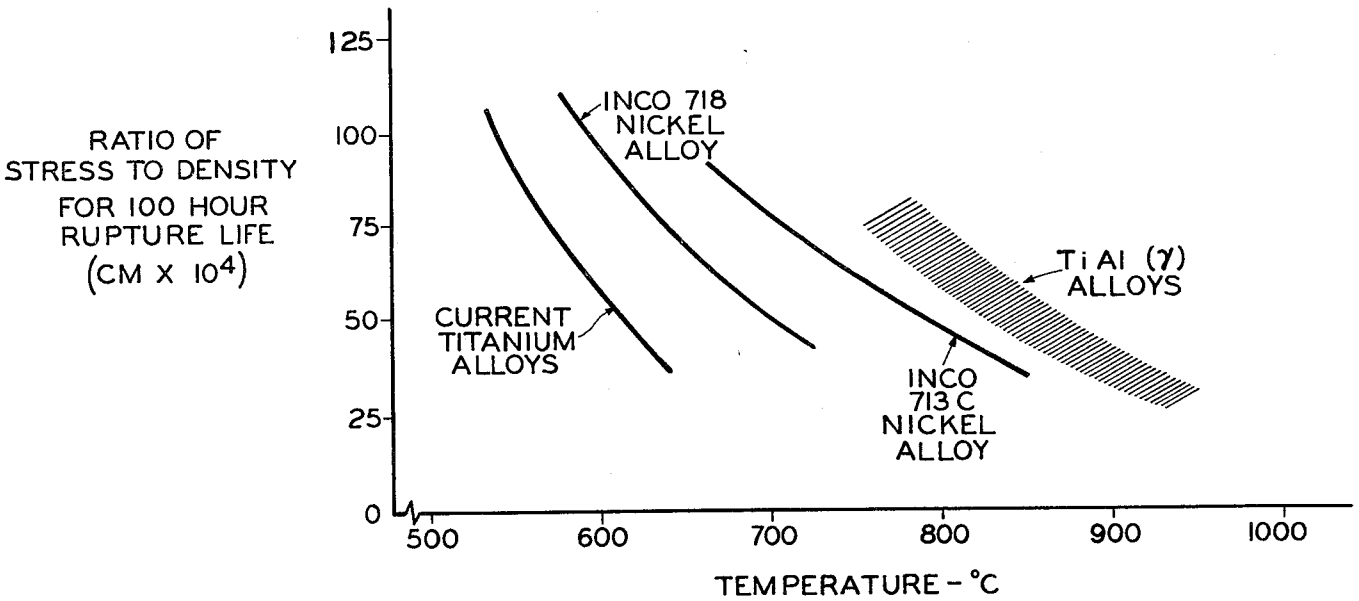
FIG. 1 shows the density corrected stress rupture capability for selected titanium and nickel base alloys and alloys of the invention.
Figure 2:
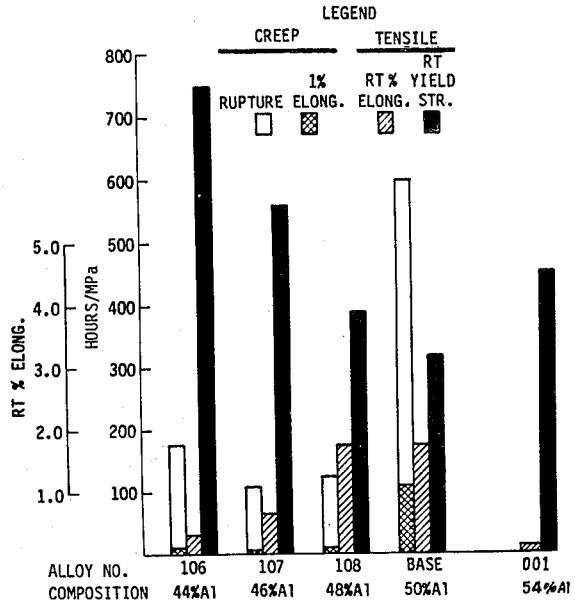
FIG. 2 shows the effect of aluminum content in binary TiAl alloys on room temperature tensile properties and 815° C./103 MPa creep life.

The initial investigation was concerned with the evaluation of alloys in the as-forged condition. In this work the effect of aluminum content in TiAl binary alloy was evaluated, with the results seen in FIG. 2. The alloy Ti-50Al was taken as the base point. It is seen that change in aluminum content is critical.

TABLE 1

| Approximate Equivalent Percents In Ti-Al Binary Alloys | |
|---|---|
| Weight Percent Ti-Al | Atomic Percent Ti-Al |
| 92-8 | 87-13 |
| 69-31 | 56-44 |
| 68-32 | 54-46 |
| 66-34 | 52-48 |
| 60-40 | 46-54 |

TABLE 2

| Alloy No. | Compositions of TiAl Alloys Investigated Weight % | Atomic % |
|---|---|---|
| V-5032 (baseline) | Ti-36.0Al | Ti-50Al |
| $T_2$A-106 | Ti-30.7Al | Ti-44Al |
| $T_2$A-107 | Ti-32.4Al | Ti-46Al |
| $T_2$A-108 | Ti-34.2Al | Ti-48Al |
| $T_2$A-118 | Ti-30.4Al-1.4V | Ti-44Al-1.0V |
| $T_2$A-111 | Ti-31.5Al-1.3V | Ti-45Al-1.0V |
| $T_2$A-122 | Ti-30.9Al-1.3V-3.0In | Ti-45Al-1.0V-1.0In |
| $T_2$A-119 | Ti-30.5Al-4.5Hf | Ti-45Al-1.0Hf |
| $T_2$A-121 | Ti-30.0Al-2.8In-4.5Hf | Ti-45Al-1.0In-1.0Hf |
| $T_2$A-112 | Ti-29.8Al-11.4Nb | Ti-45Al-5.0Nb |
| $T_2$A-131 | Ti-32.4Al-3.3V | Ti-46Al-2.5V |
| $T_2$A-128 | Ti-33.0Al-4.7W | Ti-48Al-1.0W |
| $T_2$A-132 | Ti-34.2Al-0.7V | Ti-48Al-0.5V |
| $T_2$A-125 | Ti-34.2Al-1.3V | Ti-48Al-1.0V |
| $T_2$A-127 | Ti-33.0Al-4.7W-1.3V | Ti-48Al-1.0V-1.0W |
| $T_2$A-134 | Ti-34.2Al-1.4V-0.1C | Ti-48Al-1.0V-0.2C |
| $T_2$A-126 | Ti-34.0Al-1.3V-1.0Sb | Ti-48Al-1.0V-0.3Sb |
| $T_2$A-133 | Ti-34.1Al-3.4V | Ti-48Al-2.5V |
| $T_2$A-116 | Ti-36.0Al-0.4Bi | Ti-50Al-0.1Bi |
| $T_2$A-115 | Ti-36.0Al-0.2Sb | Ti-50Al-0.1Sb |
| $T_2$A-120 | Ti-36.0Al-0.6Sb | Ti-50Al-0.2Sb |
| $T_2$A-109 | Ti-35.6Al-2.5Mo | Ti-50Al-1.0Mo |
| $T_2$A-135 | Ti-36.0Al-0.7V | Ti-50Al-0.5V |
| $T_2$A-110 | Ti-36.0Al-1.4V | Ti-50Al-1.0V |
| $T_2$A-117 | Ti-36.0Al-1.4V-0.2Sb | Ti-50Al-1.0V-0.1Sb |
| $T_2$A-129 | Ti-35.8Al-1.4V-0.9Sb | Ti-50Al-1.0W-0.3Sb |
| $T_2$A-130 | Ti-34.5Al-1.3V-4.7W-1.0Sb | Ti-50Al-1.0V-1W-0.3Sb |
| $T_2$A-136 | Ti-36.0Al-3.4V | Ti-50Al-2.5V |

Figure 3:
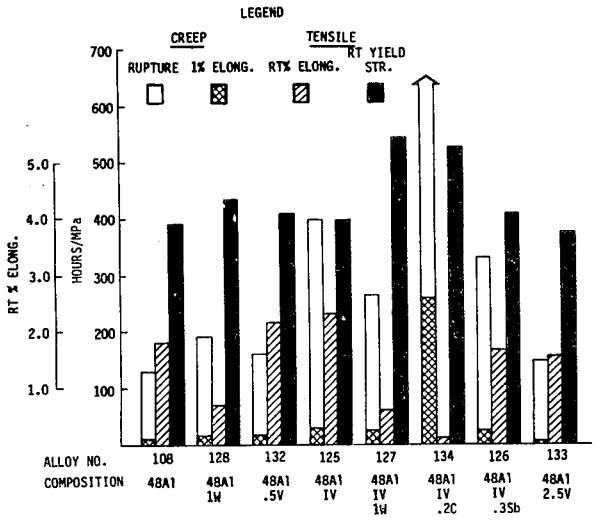
FIG. 3 shows the effect of alloying additions in Ti-48 atomic percent Al alloys on room temperature tensile properties and 815° C./103 MPa creep life.

As Al was decreased to 44%, the tensile strength increased by 200% but the ductility decreased about 84% and creep life was substantially decreased. Thus, using a nominal 1.5% ductility criterion, alloys with 48–50% were found to be preferred. Evaluation of the effects of other alloying additions were thereupon concentrated on Ti-48/50Al. Table 2 indicates some of the alloys which were further investigated. The effects of the alloying additions are summarized in FIG. 3 for Ti-48Al. Referring to FIG. 3, it can be seen that all additions increased creep life but it is seen that tungsten lowers ductility while vanadium raises or preserves it: compare alloy 128 with 125. Further, it is seen that other elements, e.g. W. and Sb in combination with V are not helpful: compare alloys 127 and 125. The effect of carbon is discussed further below. Table 3 shows the effect of alloying additions on 260° C. tensile properties. It is seen that improved tensile strength and elongation result from vanadium additions up to the 2.5% level evaluated. The situation in Ti-50Al alloys is not quite as straightforward. Most elements such as Mo and W tend to lower ductility somewhat and may reduce creep rupture properties. Vanadium additions may also lower creep capability to a limited extent and not change tensile ductility at ambient temperature. However, as shown in Table 4 improved tensile strength and ductility at intermediate 260° C. temperatures can result from vanadium additions. V also variously enhanced moderate temperature ductility and strength in less preferred Ti-44/45/46 %Al alloys.

Figure 4:
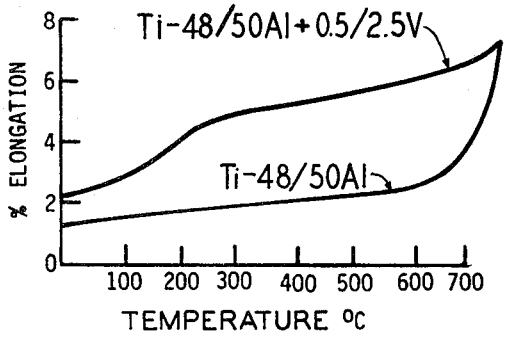
FIG. 4 indicates the effects of vanadium additions on the 20°–700° C. tensile ductility of Ti-48/50 atomic percent aluminum alloys.

FIG. 4 summarizes the mean effect of critical vanadium additions in the 0.5 to 2.5% range on Ti-48/50Al alloys over 20°–250° C. It can be seen that there is a modest but still significant improvement in low temperature ductility and a substantial improvement in moderate temperature ductility. At higher temperatures there is little effect. Earlier solubility investigations have shown that quite large concentrations of vanadium are soluble in the gamma phase; values as high as 20% have been cited.

TABLE 3

| | Tensile Properties at 260° C. For Ti-48Al a/o Alloys 0.2% YS (MPa) | UTS (MPa) | % EL |
|---|---|---|---|
| Ti-48Al | 390 | 486 | 2.1 |
| Ti-48Al -1W | 324 | 474 | 3.1 |
| -0.5V | 359 | 565 | 5.1 |
| -1V | 374 | 517 | 3.1 |
| -1V-1W | 396 | 523 | 3.2 |
| -1V-0.2C | 496 | 596 | 2.5 |
| -1V-0.3Sb | 348 | 443 | 1.8 |
| -2.5V | 337 | 536 | 5.1 |

TABLE 4

| | Tensile Properties at 260° C. For Ti-50Al a/o Alloys 0.2% YS (MPa) | UTS (MPa) | % EL |
|---|---|---|---|
| Ti-50Al -0.1Bi | 250 | 336 | 2.0 |
| -0.1Sb | 254 | 330 | 1.8 |
| -0.2Sb | 275 | 307 | 0.8 |
| -1Mo | 305 | 339 | 0.8 |
| -0.5V | 243 | 365 | 2.0 |
| -1.0V | 263 | 383 | 2.4 |
| -1V-0.1Sb | 256 | 350 | 2.0 |
| -1V-0.3Sb | 263 | 368 | 2.0 |
| -1V-1W-0.3Sb | 368 | 400 | 0.8 |
| -2.5V | 279 | 412 | 2.75 |

We have demonstrated the usefulness and uniqueness of additions of up to 2.5% in our tests, but we have not demonstrated what the upper limit of usefulness is. While we might in the future conclude that values up to the solubility limit are useful, for the present we feel that is but a small inference to assume that vanadium up to 3% will be useful, as there is no evidence of dimunition of the trend in our test range. The lower limit of our test data was 0.5%, but we believe it is reasonable to infer that lesser amounts, down to 0.1% will still give a desired ductilizing effect, but to a lesser degree.

Several elements have been identified which amplify high temperature strength. Sb, Bi and especially carbon have been found to promote creep rupture resistance. FIG. 3 shows that the addition of 0.20 carbon to a Ti-Al-V alloy more than trebles rupture life. At this level, some reduction in room temperature tensile ductility is noted. However, we believe that further experiments in the amount of carbon possible coupled with heat treatments, may eliminate the ductility decrease.

Thus, it is concluded that:

(a) To obtain adequate tensile ductility and good creep strength, a titanium aluminum alloy should preferably have an atomic aluminum content of around 48–50% (or 34 to 36 w/o).

(b) Vanadium in an alloy of 48–50%Al is beneficial in atomic amounts of 0.1 to 3% or greater (~0.1 to 4 w/o); preferred in amounts of 0.5 to 1.5% (~0.7 to 1.5 w/o) to enhance tensile ductility at low and intermediate temperatures without deleteriously degrading high temperature strength. Beta promoters, such as Mo or W, nor alpha promoters such as Bi and Sb are not similarly effective. V also imparts ductility to alloys of the less preferred compositions with 44–48%Al.

(c) Carbon in the range of 0.05 to 0.25% (0.02 to 0.12% weight), preferred in the amount of 0.1 to 0.2%C (0.05% to 0.1% weight), is advantageous in Ti-Al-V alloys of (a) and (b) above to improve high temperature properties, but with some reduction of room temperature ductility.

The alloys described herein were manufactured in heat sizes from 1-2 to 40 Kg and forged at constant temperature. The smaller size heats predominated. Standard practices and precautions in melting and forging of titanium alloys were used, to avoid well-known defects in such alloys. In particular, oxygen should be maintained below about 0.1 weight percent and other contaminations should be avoided.

Figure 5:
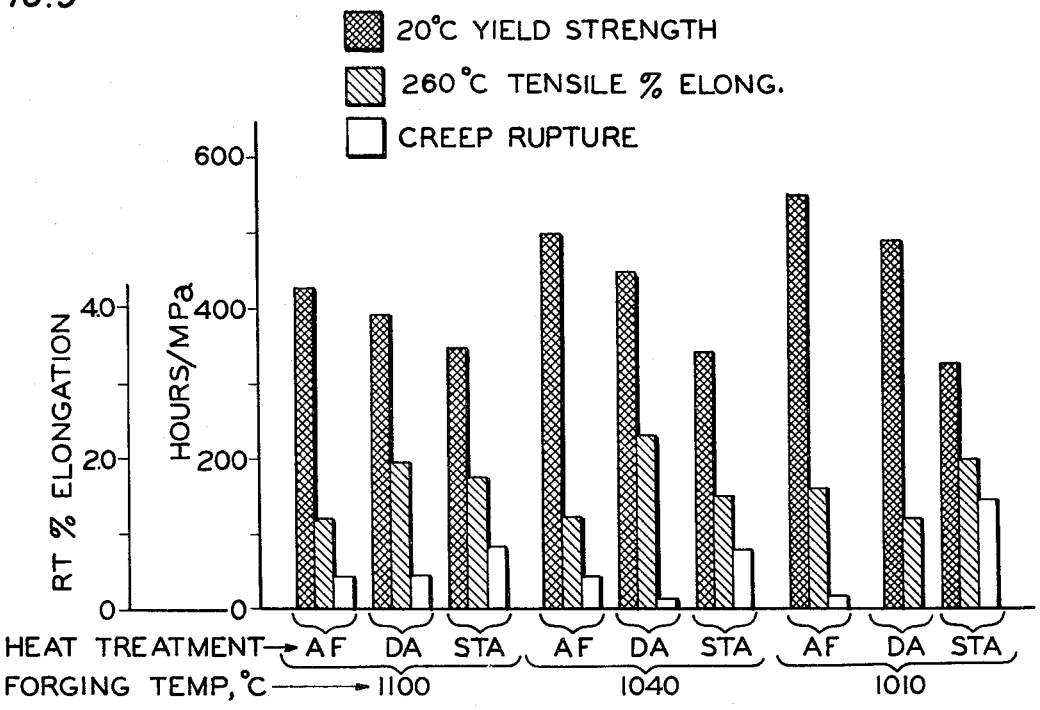
FIG. 5 shows the effect of forging and heat treatment conditions on Ti-50Al alloy.

Metallurgical analysis of the alloys within the inventive range indicate they have a two phase structure. Predominant is a gamma (TiAl) phase with a small amount of globular alpha two ($Ti_3Al$). Heat treatment studies show that the properties can be altered by manipulation of grain size and the amount and distribution of the alpha two phase. The data cited heretofore was for as-forged material; forging was at constant temperatures from about 1010° C. to 1100° C. and the test parts were air cooled. FIG. 5 illustrates the effect of direct aging (D.A.) in the 750°-1000° C. range and solution treatment at 1150°-1250° C. followed by 750°-1000° C. aging from one to eight hours; all steps followed by air cooling. Also indicated are different forging temperatures. It is seen that lowered forging temperature raises the yield strength on the whole, but lowers the creep rupture life. Direct aging tends to lower the tensile and creep strengths but increases ductility. Solution treatment and aging results in grain growth, lower tensile strength, and improved stress rupture properties.

Thus, it is concluded that the alloy is preferably used after forging at 1050° C. or less, and optionally direct aged at 750°-1000° C. If improved yield strength is desired, forging temperature should be lowered in the range 1010°-1100° C.; if improved creep rupture life is desired, the forging should be annealed at 1100°-1200° C. and then aged in the 815°-950° C. range.

We claim:

1. A cast and forged titanium alloy with ductility at room temperature and good high temperature strength, consisting essentially of by weight percent 31-36 aluminum, 0.1-4 vanadium, balance titanium (in atomic percent, about: 45-50Al, 0.1V, bal Ti).

2. A cast and forged titanium alloy with ductility at room temperature and good high temperature strength, consisting essentially of by weight percent 34-36 aluminum, 0.7-2.0 vanadium, balance titanium (in atomic percent, about: 48-50Al, 0.5-1.5V, bal Ti).

3. The alloys of claims 1 or 2 characterized by tensile elongations of greater than about 1.5% at 20° C. and 3% at 260° C.

4. The alloys of claims 1 or 2 further having up to 0.1 weight percent carbon to improve creep rupture strength.

5. The alloys of claims 1 or 2 forged at about 1000°-1050° C. and heat treated at 815°-950° C. to obtain hgh tensile strength.

6. The alloys of claims 1 or 2 forged at about 1000°-1050° C. with a two step heat treatment consisting of a solution anneal of 1100°-1200° C. followed by an aging treatment of 815°-950° C. to develop high creep-rupture strength and improved tensile ductility.

* * * * *